United States Patent [19]

Hirst

[11] Patent Number: 5,073,084

[45] Date of Patent: Dec. 17, 1991

[54] SINGLE-PRICE LABYRINTH SEAL STRUCTURE

[75] Inventor: Roy T. Hirst, Derby, England

[73] Assignee: Rolls-Royce plc, London, England

[21] Appl. No.: 583,081

[22] Filed: Sep. 17, 1990

[30] Foreign Application Priority Data

Oct. 4, 1989 [GB] United Kingdom ..... 8922339

[51] Int. Cl.[5] ..... F01D 9/00

[52] U.S. Cl. ..... 415/209.3; 415/134; 415/136; 416/204 A; 416/217; 416/219 R; 416/220 R; 416/224; 403/355; 403/378

[58] Field of Search ..... 415/134, 136–139, 415/209.2, 209.3, 174.5; 416/204 R, 204 A, 217, 219 R, 220 R, 222, 224; 403/355, 361, 378–379

[56] References Cited

U.S. PATENT DOCUMENTS

| | | | |
|---|---|---|---|
| 1,909,353 | 5/1933 | Hughes et al. | 403/361 |
| 2,872,156 | 2/1959 | Brawn | 415/209.4 |
| 2,955,800 | 10/1960 | Miller et al. | 415/138 |
| 3,356,340 | 12/1967 | Bobo | 416/220 R |
| 3,867,066 | 2/1975 | Canova et al. | 415/209.3 |

FOREIGN PATENT DOCUMENTS

| | | | |
|---|---|---|---|
| 0923227 | 2/1947 | France | 403/379 |
| 0068612 | 6/1977 | Japan | 415/137 |
| 0210104 | 12/1982 | Japan | 416/220 R |
| 0630732 | 10/1949 | United Kingdom | 416/222 |

*Primary Examiner*—Edward K. Look
*Assistant Examiner*—Christopher M. Verdier
*Attorney, Agent, or Firm*—Cushman, Darby & Cushman

[57] ABSTRACT

The normally multi-part gas turbine engine labyrinth seal outer portion which carries an abradable lining, is formed from a single piece and has a groove machined in its periphery for the receipt of the feet of respective stator vanes. Pins are fitted in pairs through the walls of the groove to provide lateral location for the feet. The pins and a groove liner are made from an anti-frettage material.

5 Claims, 2 Drawing Sheets

FIG. 4
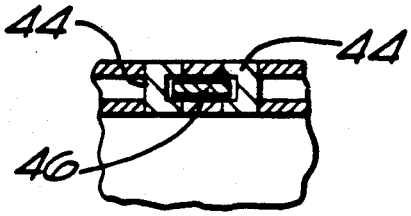
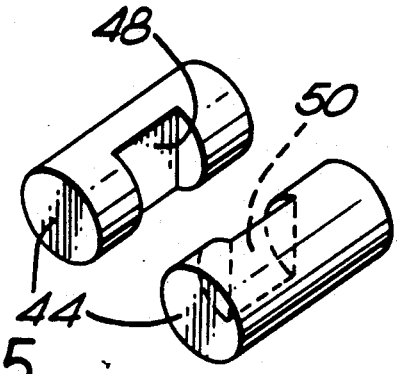
FIG. 5
FIG. 7
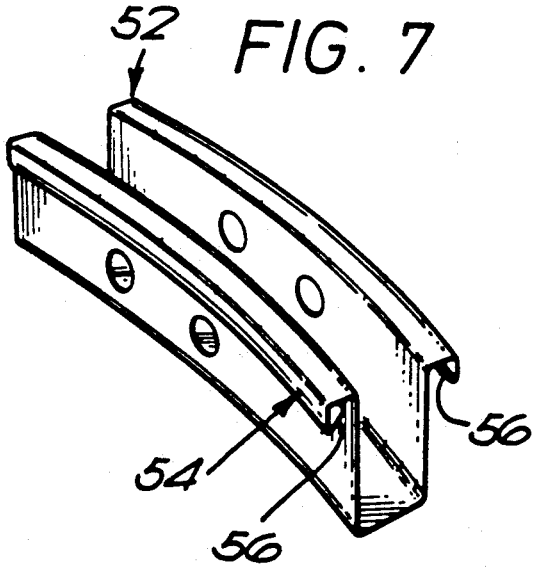
FIG. 6
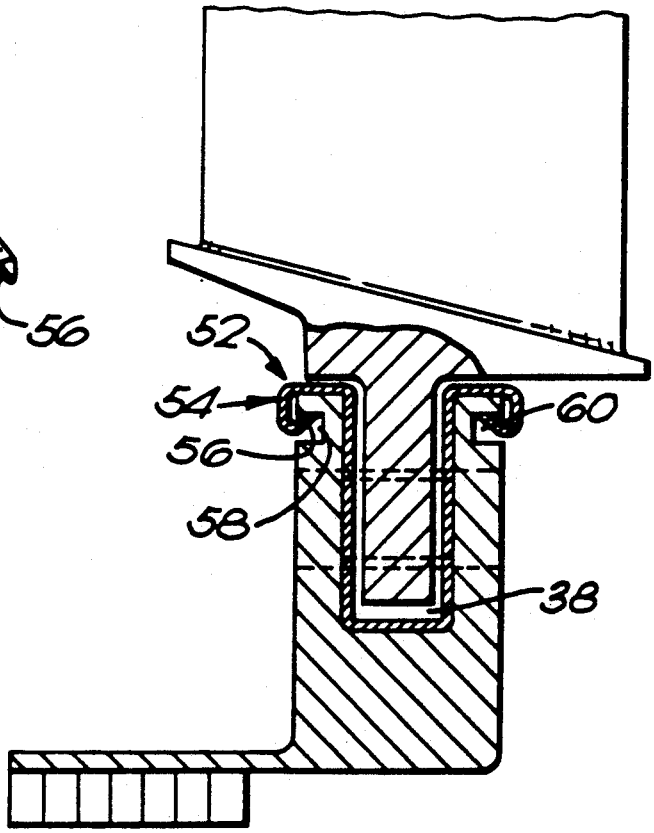

SINGLE-PRICE LABYRINTH SEAL STRUCTURE

The present invention relates to support means for labyrinth seals. The invention has particular efficacy when utilised in gas turbine engines.

A labyrinth seal of the kind mentioned herein is defined by an outer annular land which has a number of annular fins formed on its outer diameter, the fins being surrounded in close spaced relationship by a further annular land, the bore of which has an abradable lining.

The finned portion is coaxially fixed to a rotor for rotation therewith within the lined portion which in turn, is non rotatably supported by the inner ends of a fixed stage of stators or guide vanes.

It is necessary to enable relative, opposing radial growth between the stators or guide vanes and the associated further annular land which results from increases in operating temperatures in the associated engine.

It is the practice to provide the further land with an annular flange and to locate inwardly directed features on the inner ends of the stators or guide vanes between that flange and a further, separate flange, the two flanges being bolted together by a number of angularly spaced nuts and bolts.

Radial slots have to be machined in the opposing face of at least one of the flanges and the features placed therein, to be restrained against excessive movement peripherally of the flanges, by the side walls of the slots. The arrangement is expensive to produce and heavy.

The present invention seeks to provide an improved outer labyrinth seal land of the kind defined hereinbefore.

It is a further object of the present invention to provide an anti frettage liner which in operation protects the inwardly directed feature on the stator or guide vane against frettage.

According to one aspect of the present invention a labyrinth seal comprises an annular land having an internal abradable lining and an outwardly turned annular flange which has an annular groove formed in its periphery, a number of angularly spaced pairs of pins spanning the annular groove, all of said pins being fixed by their ends in the walls of the groove and wherein the pins in each pair of pins are spaced one from the other by a distance which enables the insertion therebetween of an inwardly directed feature on the inner ends of a plurality of stators or guide vanes which are to be associated therewith.

According to a further aspect of the present invention there is provided an anti frettage lining comprising a segmented annular member, wherein a substantial portion of each segment is formed so as to compliment the profile of a groove in the periphery of the outwardly turned flange of the outer portion of a labyrinth seal in which for operation the anti frettage liner is to be fitted and the resulting lips of the liner are turned back upon themselves to provide edges the distance between which is less then the thickness of the outwardly turned flange, the material from which the liner is formed being considerably harder than that of the outwardly turned flange.

The invention will now be described, by way of example and with reference to the accompanying drawings in which:

FIG. 4 is a view on line 4—4 of FIG. 2.

FIG. 5 depicts the retaining pins of FIGS. 2 to 4 inclusive.

FIG. 6 illustrates the incorporation of a further embodiment of the present invention.

FIG. 7 is a pictorial view of the further embodiment incorporated in FIG. 6.

Figure 1:
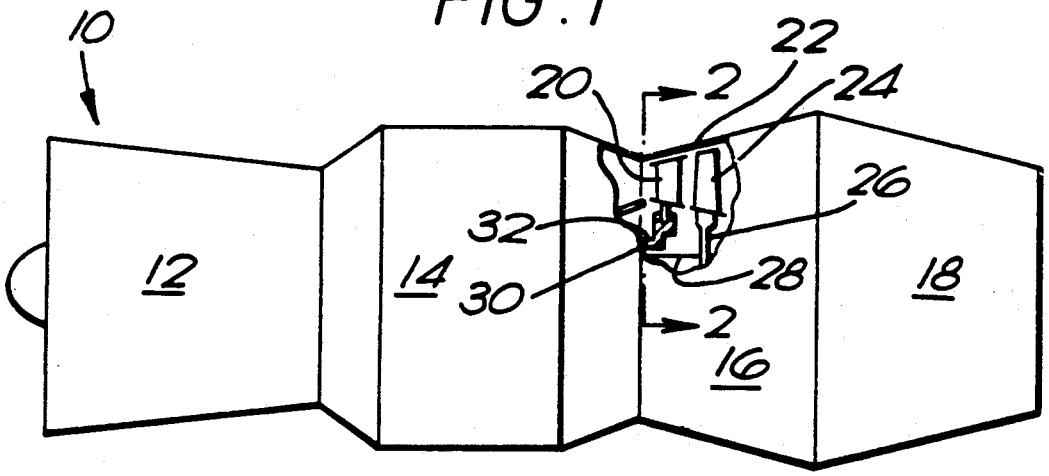
FIG. 1 is a diagrammatic view of a gas turbine engine incorporating an embodiment of the present invention.

In FIG. 1, a gas turbine engine 10 includes a compressor 12, combustion equipment 14, a turbine section 16 and an exhaust section 18, all arranged in flow series.

In this example, the turbine section has a stage of guide vanes 20 affixed in known manner via their radially outer ends, to structure within the engine turbine casing 22. A stage of rotatable turbine blades 24 is positioned immediately downstream of the stage of guide vanes 22, again in known manner.

The turbine disc 26 has an annular land 28 bolted to its upstream face, which land extends forwardly and terminates under the guide vanes 20. That portion of the land 28 which lies under the guide vanes 20 has annular fins 30 formed on its outer diameter in known manner and these are surrounded in close spaced relationship by a further annular land 32 which has an abradable lining (not shown in FIG. 1) in its bore, again in known manner.

Figure 2:
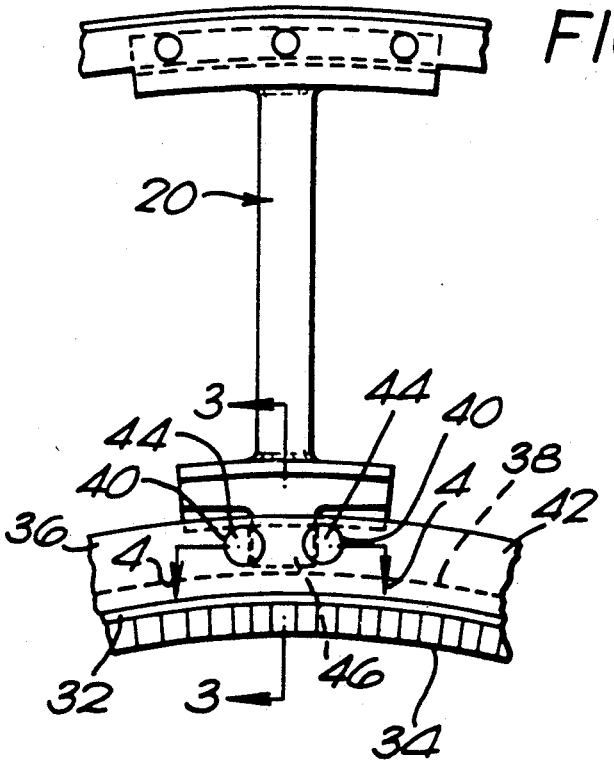
FIG. 2 is an enlarged view on line 2—2 of FIG. 1.

In FIG. 2, the land 32 with its associated abradable lining 34 has an outwardly turned annular flange 36 formed at its downstream end. The flange 36 has an annular groove 38 formed in its periphery. A plurality of equi-angularly spaced pairs of holes 40, only one of which pairs is shown, are drilled through the resulting walls 42 of the groove 38 and a pin 44 is fitted in each hole 42. It is intended that the pins 44 should stay in situ until their replacement through wear is necessitated. They may thus be a press fit or may be brazed via their ends to the groove walls 42, or both.

Each pin 44 in a pair of pins is spaced one from the other by a distance which will allow the insertion of a foot 46 therebetween one of which feet 46 projects from the underside of each respective guide vane 20. It follows that the number of pairs of pins 44 equals the number of guide vanes 20 in the stage.

Figure 3:
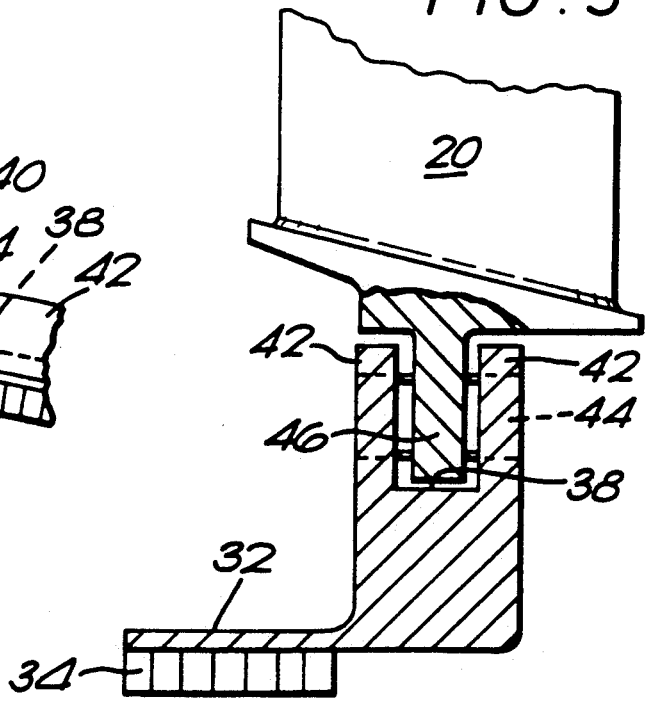
FIG. 3 is a view on line 3—3 of FIG. 2.

Each guide vane 20 is affixed via its outer end to fixed engine structure in known manner. Consequently, during operation of the engine 10, when the guide vanes 20 become heated, they expand radially inwardly towards the engine axis. Conversely the land 32 and its associated grooved flange 36 expand radially outwardly from the engine axis. Thus there must be an appropriate clearance between the feet 46 and the associated pins 44. This is shown in FIGS. 2 and 4. There must also be a clearance between the feet 46 and the walls 42 of the groove 38. This is shown in FIG. 3.

In FIG. 5, the pins 44 in the present example are relieved at 48 and 50 respectively, so as to provide flat opposing faces. A greater surface area is thus provided for the feet 46 (not shown in FIG. 5) to bear on. This, depending on the friction characteristics of the assembly, which would be ascertained on test of the associated engine, may prove to be an unnecessary step. In any event, the contacting surfaces of the feet 46 and the inner surface of walls 42 will be pre-coated with an anti frettage material e.g. a material sold under the proprietary name "HAYNES 25". The coating may be applied by hot spraying of the material onto the appropriate surfaces. Alternatively, a preform liner 52 as depicted in FIG. 6 may be used to cover the profile of the groove 38. The preform liner 52 will be provided with holes corresponding to the holes 40 in flange 36 through which pins 44 extend as shown in FIG. 6.

The preform 52 which is depicted per se in FIG. 7 could be produced by hot spraying as with a plasma gun, a metal powder onto a disposable core (not shown) and would have its lips 54 turned inwardly upon themselves so as to provide upwardly turned edges 56 within the maximum width of the preform 52 and which on fitting of the preform within the groove 38, will clip into further grooves 58 and 60 in the outer surfaces of the walls 42.

The pins 44 will be manufactured from the anti frettage material.

The obviation of a groove formed by an assembly of separate flanges, along with associated fastening and locking devices, and of the need for extensive machining operation which such arrangements made necessary, results in a considerable cost and weight reduction and a simplified assembly procedure.

I claim:

1. A labyrinth seal for a gas turbine engine of the type having an airstream flow therethrough, said engine having a radial pattern of stator vanes therein, each said stator vane having proximal and distal ends, said labyrinth seal comprising an annular land having an abradable lining and a radially outwardly turned annular flange which has an annular groove formed in its periphery, said annular groove having walls, said outwardly turned annular flange further having an upstream face and a downstream face with respect tot he airstream within said gas turbine engine, with each said face having a groove formed therein, a number of angularly spaced pairs of pins with ends, where said pins span the annular groove, each pin being fixed by its ends in said walls of said annular groove and wherein the pins of each said pair of pins are spaced, one from the other, by a distance which enables the insertion therebetween of an inwardly directed feature on the proximal ends of a plurality of stator vanes, where each said inwardly directed feature is retained by a particular pair of pins, said labyrinth seal further including a liner comprising a generally "U" section shaped segment made from anit-frettage material, said liner having free edge portions which are turned outwardly, downwardly, inwardly, and upwardly so as to enable spring clipping of said liner in a retaining manner in said annular groove, each said free edge of said liner being disposed in said groove provided in said respective upstream and said downstream faces of said annular flange, said liner segment being proportioned so as to fit closely against the walls within said annular groove, said liner having holes therein for the passage of said pins therethrough.

2. A labyrinth seal as claimed in claim 1 wherein each pin has a selected length and a flat formed on a mid portion of each said length and the pins are oriented such that the flats on the pins in each pair of pins face each other, so as to provide opposing planar bearing surfaces for respective stator vane features.

3. A labyrinth seal as claimed in claim 1 wherein each pin is made from an anti-frettage material.

4. A labyrinth seal as claimed in claim 2 wherein each pin is made from an anti-frettage material.

5. A liner for lining an annular groove having walls, said groove being formed in radially outwardly turned flanges on a labyrinth seal structure for a gas turbine engine, said outwardly turned flanges having an upstream face and a downstream face with respect to an air flow within said gas turbine engine, said liner comprising a generally "U" section segment made from an anti-frettage material and proportioned so as to fit closely against the walls within the groove and having means for retaining said segment therein, said liner having free edges which are turned outwardly, downwardly, inwardly, and upwardly so as to enable spring clipping of the said liner in retaining manner in said annular groove, said free edges on said liner, when in situ, being located in respective grooves provided in said upstream and downstream faces of said annular flange of said labyrinth seal.

* * * * *